US008165481B2

(12) United States Patent
Iimura

(10) Patent No.: US 8,165,481 B2
(45) Date of Patent: Apr. 24, 2012

(54) IMAGE FORMING METHOD AND APPARATUS THAT DETECT AN IMAGE DENSITY

(75) Inventor: Haruo Iimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 561 days.

(21) Appl. No.: 12/275,677

(22) Filed: Nov. 21, 2008

(65) Prior Publication Data

US 2009/0142087 A1 Jun. 4, 2009

(30) Foreign Application Priority Data

Dec. 4, 2007 (JP) ..... 2007-313550
Mar. 6, 2008 (JP) ..... 2008-055747
Apr. 2, 2008 (JP) ..... 2008-095598
Oct. 7, 2008 (JP) ..... 2008-260353

(51) Int. Cl.
*G03G 15/08* (2006.01)

(52) U.S. Cl. ..... 399/29; 399/27

(58) Field of Classification Search ..... 399/27–29, 399/49, 74

See application file for complete search history.

(56) References Cited

U.S. PATENT DOCUMENTS

2006/0188277 A1* 8/2006 Nishida et al. ..... 399/49
2008/0075484 A1* 3/2008 Komiya ..... 399/39

FOREIGN PATENT DOCUMENTS

| | | |
|---|---|---|
| JP | 6-167886 | 6/1994 |
| JP | 7-92753 | 4/1995 |
| JP | 8-123263 | 5/1996 |
| JP | 9-34243 | 2/1997 |
| JP | 2003-207958 | 7/2003 |
| JP | 2004-170660 | 6/2004 |
| JP | 2004-239978 | 8/2004 |
| JP | 2005-62858 | 3/2005 |
| JP | 2005-195973 | 7/2005 |
| JP | 2007-94282 | 4/2007 |
| JP | 2007-206496 | 8/2007 |

* cited by examiner

*Primary Examiner* — David Gray
*Assistant Examiner* — Rodney Bonnette
(74) *Attorney, Agent, or Firm* — Oblon, Spivak, McClelland, Maier & Neustadt, L.L.P.

(57) ABSTRACT

An image forming method includes detecting a toner degradation state by detecting an image density on an electrostatic latent image carrier with high sensitivity and low cost. The degraded toner is processed based on the detected information, so that the waste toner can be reduced and a good image can be obtained. An image density of an image that is transferred with a predetermined reference electric field is detected in a first detecting step. An image density of an image that is transferred with an electric field that is smaller or greater than the reference electric field is detected in a second detecting step. A processing step of processing the degraded toner is performed on the basis of the image density detected by each of the detecting steps.

16 Claims, 12 Drawing Sheets

IMAGE FORMING METHOD AND APPARATUS THAT DETECT AN IMAGE DENSITY

BACKGROUND OF THE INVENTION

1. Field of the Invention

The present invention generally relates to image forming methods and image forming apparatuses.

2. Description of the Related Art

Various methods of electrophotography are known. Generally, the surface of an image carrier is charged and then exposed to light to form an electrostatic latent image thereon. The electrostatic latent image is then developed using a toner, whereby a toner image is formed on the image carrier. The toner image on the image carrier is further transferred to a recording material as a transfer material, either directly or via an intermediate transfer member. The thus transferred toner image is fused by the application of heat and/or pressure, whereby a recorded item with the image formed thereon is obtained. The toner that may remain on the image carrier after the toner image is transferred is cleaned in a manner known in the art, such as with the use of a blade, a brush, or a roller, for example.

One direction in which the state-of-the-art electrophotographic technology is headed is the increase in the speed of color image output. In order to accelerate the output of color images, a tandem-type electrophotography system is used in which plural image carriers and developing devices are employed. In this technology, a color toner image formed on each of the image carriers is transferred to a recording material either directly or via an intermediate transfer member. Particularly, a transfer system involving an intermediate transfer member simplifies the transport of the recording material, and is also capable of handling various types of recording material. Thus, such a transfer system is adopted in various image forming apparatuses.

There is also the trend of increasing the process speed in order to achieve a further increase in speed. This has resulted in greater stress to which the toner is exposed within the system. The increase in stress to the toner leads to various problems, such as variations in the toner's charge characteristics and a decrease in toner fluidity due to the detachment of an additive from the toner surface into the toner. As a result, the rate of degradation of the toner increases. One of the measures to control such toner degradation is to increase the granule size of the additive so that the additive does not become buried in the toner. However, as the granule size of the additive increases, the additive can separate from the toner with increasing ease, often resulting in damaging the image carrier. Thus, it is difficult to prevent toner degradation.

Degradation of the toner causes changes in the amount of charged toner, charge amount distribution, or toner flow property, resulting in an increased frequency of the case of abnormal images with problems such as scumming and an image density decrease. Thus, the development of at least these abnormal images must be prevented in order to properly operate an image forming apparatus.

Japanese Laid-Open Patent Application No. 09-34243 discloses that, based on the assumption that the toner degradation is inevitable, the degraded toner is forcibly developed at certain intervals of image output, so that the toner can be collected in a cleaning step. However, such compulsory consumption of toner at regular intervals of image output produces a large amount of waste toner.

In order to reduce the amount of waste toner, the state of degradation of toner is detected so that the degraded toner can be processed efficiently based on the detected state of toner degradation. Various methods for detecting the state of degradation of toner have been proposed.

For example, Japanese Laid-Open Patent Application No. 8-123263 discloses that the potential of a developed toner layer is detected in order to determine the degree of toner degradation based on a shift in the potential. In other examples, the image density of a developed toner layer is detected, or the degradation of toner or developing agent is determined based on a combination of image density detection and toner density detection.

Japanese Laid-Open Patent Application No. 2005-62858 discloses a method for visualizing the attachment of toner to a non-image portion (fogging), which is caused by the increase of the toner with the opposite charge polarity to the normal charge polarity due to the degradation of the developing agent. In this method, the developing bias and/or the transfer bias is controlled in order to cause a stripe pattern to appear on a recording medium or an intermediate transfer member, thus enabling the detection of a fog.

Japanese Laid-Open Patent Application No. 2004-239978 discloses that the image density of a developed toner layer is detected, and a developing capacity varying unit is controlled based on a detected result, so that the image quality degradation can be controlled.

Japanese Laid-Open Patent Application No. 2007-206496 discloses that a halftone patch is produced and its density is detected. Based on a relationship between input data and the output density, the degraded toner is forcibly discharged and new toner is supplied, thus controlling the toner density and stabilizing the charging efficiency of the developing agent.

Japanese Laid-Open Patent Application No. 2004-170660 discloses that the degree of degradation of developing agent is accurately determined based on measurement values obtained by an optical toner density sensor and a permeability sensor. The image forming conditions are changed, or the developing agent in the developing unit is exchanged based on the identified degree of toner degradation, in order to form an image stably.

The foregoing examples involve detection based on the developed toner layer, wherein changes in development characteristics are detected. Development characteristics are influenced by various factors. Those factors include the charge property of the material of a carrier or the like for imparting charge to the toner, and the charge property or the powder characteristics, such as flow property, of the toner. Particularly, the influence of a change in the charged amount of toner is large, while the development characteristics are less sensitive to a change in powder characteristics of the toner such as its flow property.

Meanwhile, various methods for detecting toner degradation by detecting the image density after the transfer step have been proposed. Japanese Laid-Open Patent Application No. 2003-207958 discloses that the amount of remaining toner on the photosensitive drum is detected after a reference toner image is transferred to a transfer medium under certain transfer conditions or under transfer conditions opposite to normal conditions. Then, the amount of the oppositely charged component of the toner in the developing unit is determined. Based on the thus determined amount, the developing conditions are changed or the developing agent is replaced.

However, because the developed amount of toner or the transfer rate varies depending on the amount of charge on the toner or its powder characteristics, it cannot be determined whether the charge amount has changed due to the environment, or whether the charge amount or the powder characteristics have changed due to degradation of toner, even if the residual toner amount is detected under certain developing and transfer conditions.

Japanese Laid-Open Patent Application No. 7-92753 discloses that the developed amount of toner and the transferred amount of toner, or the developed amount of toner and the residual toner amount after the transfer step are detected by a single image density sensor in order to determine the transfer rate. When the toner characteristics are changed by degradation, the transfer conditions are adjusted so that the transfer rate remains within an appropriate range.

In this method, when detecting the developed amount of toner and the transferred amount of toner, a both-side print mode is selected and a developed image is once transferred to the recording material, and then the image is developed again and the developed amount of toner is determined, followed by detecting the transferred amount of toner on the printed surface of the inverted recording material. Thus, this method cannot be applied when an intermediate transfer member is involved.

Furthermore, when detecting the developed amount and the residual toner amount, it is necessary to detect the developed amount before the transfer step, and then develop the image and detect the residual toner amount after the transfer step. Thus, the toner that is used for the detection of the developed amount is disposed of, resulting in an increase in the waste toner amount.

Further, when detecting the developed amount, the amount of attached toner is detected after passing through the transfer area. Thus, when an intermediate transfer member is used, the developed layer comes into contact with the intermediate transfer member so that a part of the developed layer becomes attached to the intermediate transfer member, thereby preventing an accurate detection of the developed amount of toner.

Transfer characteristics are greatly influenced by the attaching force between the toner and various members, and are more sensitive than the development characteristics to the detection of a change in powder characteristics due to degradation. It is necessary, as mentioned above, to detect the developed amount and the transferred amount or the residual toner amount when detecting the transfer characteristics. This results in an increase in cost to provide plural detecting elements, or limitations in the type of detection system in which such detection can be made although there may be no increase in the number of detecting elements.

SUMMARY OF THE INVENTION

It is therefore a general object of the present invention to provide an image forming apparatus in which one or more of the aforementioned problems of the prior art are eliminated.

A more specific object is to provide an image forming apparatus employing an intermediate transfer member, in which the state of toner degradation can be detected with high sensitivity and at low cost based on detected information including powder characteristics of the toner, and in which a toner discharge operation or the like is performed so that the amount of waste toner can be reduced and good images can be obtained.

In one aspect, the invention provides an image forming method comprising an electrostatic latent image forming step of forming an electrostatic latent image on an electrostatic latent image carrier; a developing step of forming a toner image of the electrostatic latent image on the electrostatic latent image carrier; a transfer step of transferring the toner image to an intermediate transfer member by forming an electric field between the electrostatic latent image carrier and the intermediate transfer member; a first detecting step of detecting an image density of an image that is transferred using a predetermined reference electric field; a second detecting step of detecting an image density of the image that is transferred using an electric field that is smaller or greater than the reference electric field; and a processing step of processing a degraded toner based on the image density detected by each of the first detecting step and the second detecting step.

In a preferred embodiment, each of the first and the second detecting steps includes detecting the image density of an image on the electrostatic latent image carrier.

In a preferred embodiment, the predetermined reference electric field is an electric field that maximizes the transfer rate.

In another preferred embodiment, the processing step includes moving degraded toner in the developing device onto the electrostatic latent image carrier.

In another preferred embodiment, whether the processing step of processing the degraded toner should be performed or not is determined by comparing a ratio of the image density detected by the first detecting step to the image density detected by the second detecting step with a predetermined threshold value.

In another preferred embodiment, whether the processing step of processing the degraded toner should be performed or not is determined by comparing a difference between the image density detected by the first detecting step and the image density detected by the second detecting step with a predetermined threshold value.

In another preferred embodiment, each of the first and the second detecting steps includes detecting the image density of an image on the intermediate transfer member.

In another preferred embodiment, the predetermined reference electric field is an electric field that maximizes the transfer rate.

In another preferred embodiment, the processing step includes moving the degraded toner in a developing device onto the electrostatic latent image carrier.

In another preferred embodiment, whether the processing step of processing the degraded toner should be performed or not is determined by comparing a ratio of the image density detected by the first detecting step to the image density detected by the second detecting step with a predetermined threshold value.

In yet another preferred embodiment, whether the processing step of processing the degraded toner should be performed or not is determined by comparing a difference between the image density detected by the first detecting step and the image density detected by the second detecting step with a predetermined threshold value.

In a further embodiment, the second detecting step includes detecting the image density of the image that is transferred using plural electric fields.

In a further embodiment, the electric field between the electrostatic latent image carrier and the intermediate transfer member is controlled with a current.

In another embodiment, the electric field between the electrostatic latent image carrier and the intermediate transfer member with a voltage.

In yet another embodiment, the electrostatic latent image forming step, the developing step, and the transfer step are performed for each of plural colors, wherein each of the first detecting step and the second detecting step includes detecting an image density of each color of the image.

In another aspect, the invention provides an image forming apparatus comprising an electrostatic latent image carrier on which a latent image is formed; a charging device configured to charge a surface of the electrostatic latent image carrier uniformly; an exposing device configured to expose the charged surface of the electrostatic latent image carrier to light in order to write a latent image on the surface; a developing device configured to supply a toner to the latent image formed on the surface of the electrostatic latent image carrier in order to render the latent image visible; a cleaning device configured to clean the surface of the electrostatic latent image carrier to remove residual toner; a transfer device configured to transfer the visible image on the surface of the electrostatic latent image carrier to a recording medium directly or via an intermediate transfer member; and a fusing device configured to fuse the toner image on the recording medium. An image density of an image that is transferred using a predetermined reference electric field is detected, and an image density of the image that is transferred using an electric field that is smaller or greater than the reference electric field is detected. The degraded toner is processed based on the image density of the image transferred using the reference electric field and the image density of the image transferred using the electric field that is smaller or greater than the reference electric field.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

In the following, a description is given of preferred embodiments of the present invention with reference to the drawings. It is to be understood that the embodiments are merely illustrative of some of the many specific embodiments that represent applications of the principles of the present invention. Clearly, numerous and other arrangements can be readily devised by those skilled in the art without departing from the scope of the invention.

Figure 1:
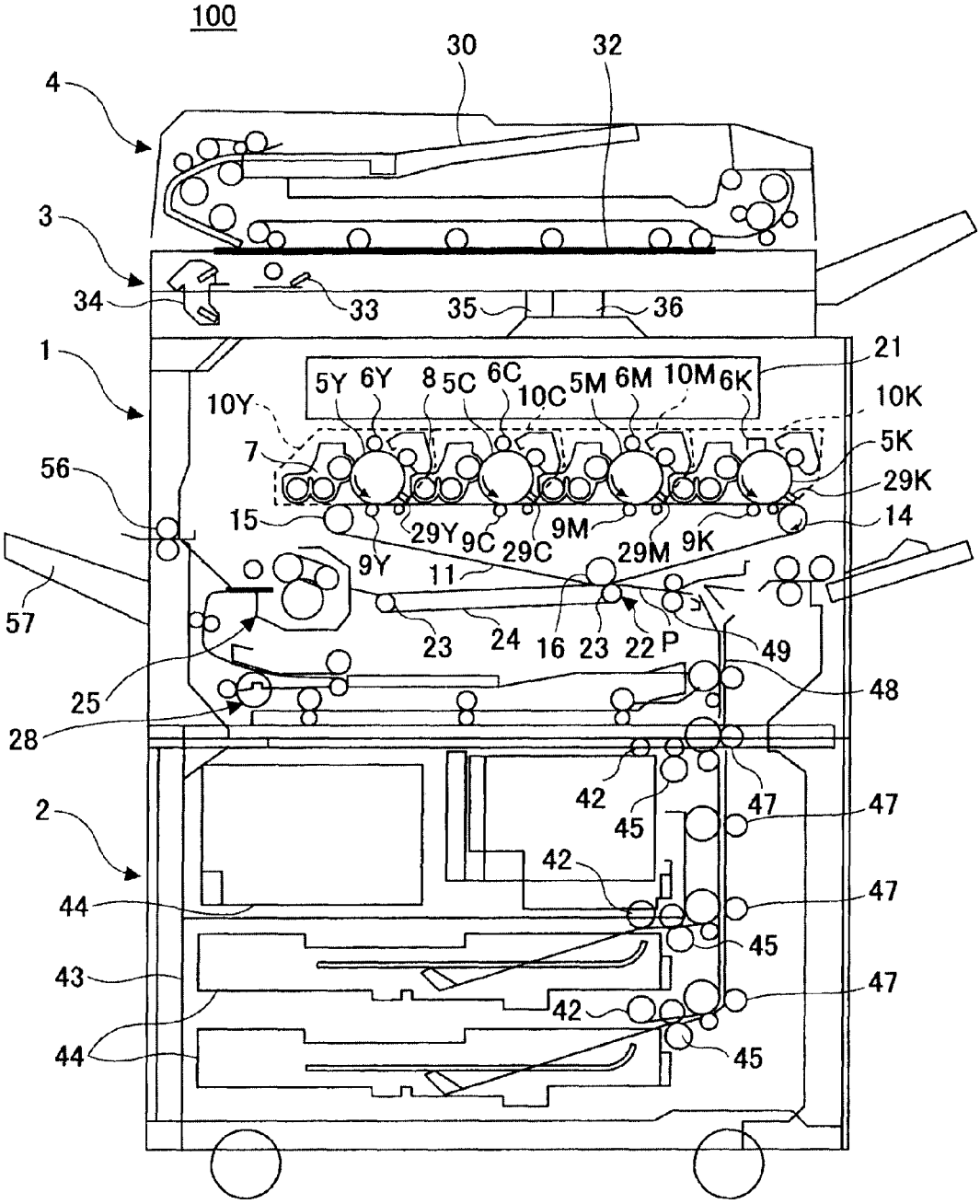
FIG. 1 shows a color image forming apparatus in which an image forming method according to an embodiment of the present invention is performed.

FIG. 1 schematically shows a color image forming apparatus 100 according to an embodiment of the present invention. The image forming apparatus 100 is a tandem-type electrophotography apparatus that employs an intermediate transfer belt 11. The color image forming apparatus 100 includes a sheet-feeding table 2 in a bottom portion thereof, above which an image forming apparatus main body 1, a scanner 3, and an automatic document feeder (ADF) 4 are further disposed.

The color image forming apparatus 100 performs an image forming method according to an embodiment of the present invention. The image forming method includes an electrostatic latent image forming step, a developing step, a transfer step, a cleaning step, and a fusing step. The color image forming apparatus 100 is described in greater detail below.

At substantially the center of the image forming apparatus main body 1, there is disposed a transfer device 9 that includes the intermediate transfer belt 11, which is an endless belt. The intermediate transfer belt 11 is extended and rotated via a drive roller 14, and driven rollers 15 and 16. In an area above and to the left of the driven roller 15, a belt cleaning device (not shown) is disposed, by which the residual toner on the surface of the belt 11 after the image transfer step is removed in preparation for the next sequence of image formation.

Above the linear portion of the intermediate transfer belt 11 between the drive roller 14 and the driven roller 15, there are disposed photosensitive members 5Y (yellow), 5C (cyan), 5M (magenta), and 5K (black). These photosensitive members may be hereafter referred to as simply "photosensitive members 5" when the individual colors need not be identified. The photosensitive members 5 are rotatable in the direction of movement of the belt 11. Each of the photosensitive members 5 is surrounded by a developing device 7, a charging device 6, and a photosensitive member cleaning device 8, forming an individual image forming unit 10. The developing device 7 of the image forming unit 10 performs the developing step.

Above the photosensitive members 5, there is disposed an exposing device 21 configured to emit laser light with which the photosensitive members 5 can be irradiated in a manner well known in the art. The exposing device 21 performs the electrostatic latent image forming step.

Primary transfer rollers 9Y, 9C, 9M, and 9K form a primary transfer unit. Near each of the photosensitive members 5, there is provided an image density detecting unit 29 (29Y, 29C, 29M, or 29K). Each of the photosensitive members 5 is also provided with a neutralizing device and a lubricant applying device, which are not shown, forming an individual image forming portion 10 (10Y, 10C, 10M, or 10K).

Under the intermediate transfer belt 11, there is disposed a secondary transfer device 22. The secondary transfer device 22 is configured to be pressed against the driven roller 16 via the intermediate transfer belt 11. The secondary transfer device 22 is configured to transfer a toner image on the intermediate transfer belt 11 onto a sheet P as the sheet P, which is a recording medium, is fed between the intermediate transfer belt 11 and the secondary transfer device 22.

Downstream of the direction of transport of the sheet P away from the secondary transfer device 22, there is provided a fusing device 25. The sheet P with the transferred image is conveyed to the fusing device 25 by an endless conveyor belt 24 extended between a pair of rollers 23. The fusing device 25 is configured to fuse the toner image on the sheet P via a pressure roller using heat and pressure.

The secondary transfer device 22 may comprise transfer rollers or a contactless charger as a transfer mechanism. The primary transfer unit 9, together with the intermediate transfer belt 11, performs the transfer step.

Under the secondary transfer device 22, there is disposed a sheet inverting device 28 configured to invert the sheet P when forming an image on both sides of the sheet.

When the color image forming apparatus 100 is operated to make a color copy, a manuscript is normally set on a manuscript base 30 of the automatic document feeder 4. When setting the manuscript manually, the automatic document feeder 4 is opened and the manuscript is set on a contact glass 32 of the scanner 3. The manuscript is pressed against the contact glass 32 when the automatic document feeder 4 is closed.

As a start switch (not shown) is pressed, the manuscript set on the automatic document feeder 4 is automatically sent onto the contact glass 32. Alternatively, when the manuscript is manually set on the contact glass 32, the scanner 3 is immediately activated, and a first running body 33 and a second running body 34 start running. Thereby, the light emitted by a light source of the first running body 33 is shone onto the manuscript. The light reflected by the manuscript is reflected by a pair of mirrors of the second running body 34. The direction of travel of the reflected light is changed by the mirrors by roughly 180° so that the light passes through a focusing lens 35 and becomes incident on a reading sensor 36, by which the content of the manuscript is read.

Also upon pressing of the start switch, the intermediate transfer belt 11 and the photosensitive members 5Y, 5C, 5M, and 5K start rotating, so that an image with the color of yellow, cyan, magenta, or black can be formed on one of the photosensitive members for the corresponding color. The individual single-color images thus formed on the individual photosensitive members are successively transferred onto the intermediate transfer belt 11 one color upon another, as the belt rotates in the clockwise direction in FIG. 1, thereby forming a full-color composed color image.

Meanwhile, a sheet-feeding roller 42 of a selected one of the sheet feeding stages within the sheet-feeding table 2 is rotated in order to feed the sheet P out of a selected sheet-feeding tray 44 in a sheet-feeding unit 43. The sheets P are separated by a separating roller 45 and conveyed to a conveyance guide plate 48. The sheet P is then conveyed to the main body 1 by a conveying roller 47 until the sheet P abuts against a resist roller 49 where the sheet P is placed in a standby status.

The resist roller 49 starts rotating at an accurate timing synchronized with the color image on the intermediate transfer belt 11. Thereby, the sheet P is sent between the intermediate transfer belt 11 and the secondary transfer device 22 (with is a roller), and the color image is transferred to the sheet P. The sheet P with the transferred color image is then conveyed to the fusing device 25 by the secondary transfer device 22, which includes a conveying function. The fusing device 25 fuses the transferred image by applying heat and pressure, thus performing the fusing step.

Thereafter, the sheet P is guided toward the ejection end, where the sheet P is ejected by a discharge roller 56 onto an ejected sheet tray 57.

When the both-side copy mode is selected, the sheet P with the image formed on one surface thereof is conveyed to the sheet inverting device 28, where the sheet P is inverted and further guided back to the secondary transfer device 22. After an image is formed on the reverse surface, the sheet P is ejected by the discharge roller 56 onto the ejected sheet tray 57 and stacked therein.

When a black single-color image is formed on the intermediate transfer belt 11, the driven rollers 15 and 16 are moved so that the photosensitive members 5Y, 5C, and 5M for the colors yellow, cyan, and magenta are spaced apart from the intermediate transfer belt 11. In the case of the so-called "one-drum" type of image forming apparatus 1, which has a single photosensitive member 5, instead of the tandem-type shown in FIG. 1, generally a black image is formed first in order to increase the first copy speed. The remaining colors are thereafter formed only when the manuscript contains multiple colors.

Thus, in the color image forming apparatus 100 according to the present embodiment, the exposing device 6, the developing device 7, and the transfer device 9 are used to form a visible image of the toner image from the electrostatic latent image on the photosensitive member 5. In the present embodiment, the image density detecting unit 29 is further employed to measure the image density on the photosensitive member 5 after the transfer step, in order to detect the state of toner degradation.

The image density detecting unit 29 is disposed between the transfer device 9 and the photosensitive member cleaning device 8, and is configured to detect the image density of the residual toner image on the photosensitive member 5 after the transfer step.

Figure 2:
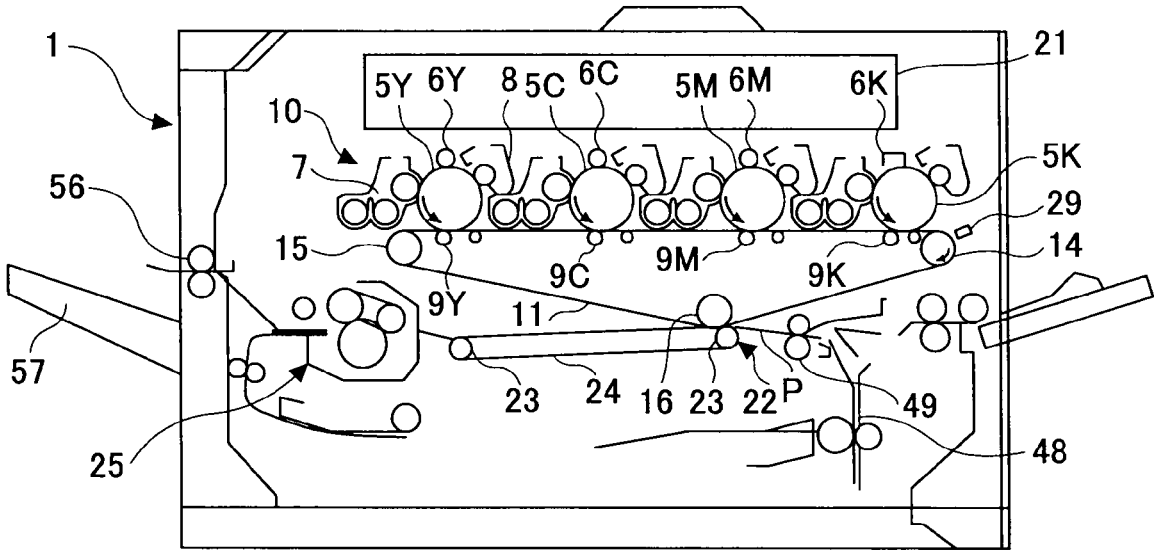
FIG. 2 shows an image forming apparatus main body of the color image forming apparatus shown in FIG. 1.

Alternatively, the image density detecting unit 29 may be disposed near the intermediate transfer belt 11 instead of the photosensitive member 5, and configured to detect the image density of the transferred toner image on the intermediate transfer belt 11. FIG. 2 shows an example in which the image density detecting unit 29 is disposed near the intermediate transfer member 11.

The image density detecting unit 29 may comprise any of known various sensors, such as an optical sensor. The optical sensor may contain a light-emitting element and a light-receiving element, so that the amount of light reflected by the surface of the photosensitive member 5 and the amount of light reflected by the toner on the photosensitive member 5 can be compared. Based on such a comparison of amounts of reflected light detected by the optical sensor, the image density of the attached toner can be detected.

Although the attached toner amount or the image density may be detected by detecting the charge potential of a toner image, the above-mentioned method of image density detection is more advantageous because the detection of charge potential is subject to changes in the charged toner amount due to environmental conditions or the like.

Figure 3:
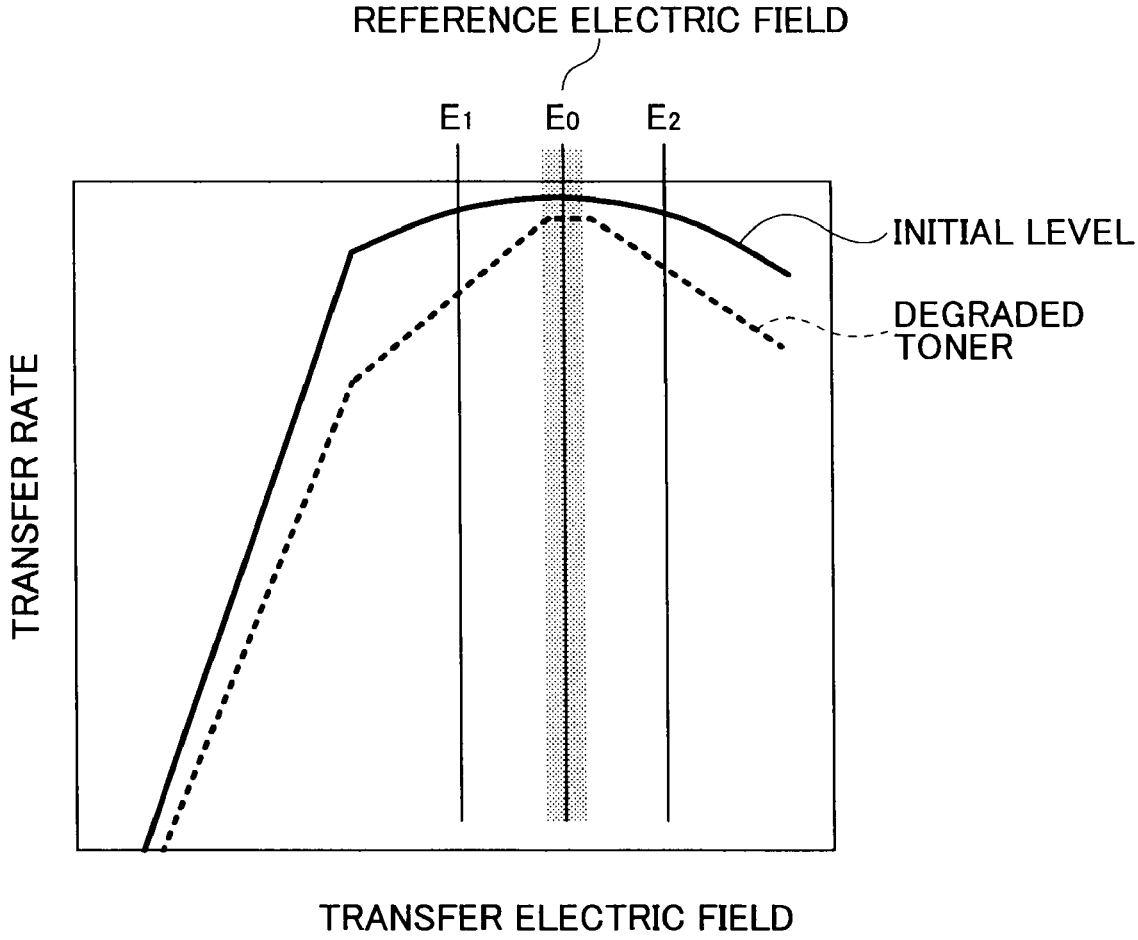
FIG. 3 shows a graph indicating relationships between transfer electric field and transfer rate.

FIG. 3 shows a graph indicating a relationship between transfer electric field and transfer rate. The transfer rate is measured as follows.

A solid image is developed on the photosensitive member 5, and the process is interrupted during the primary transfer step. The photosensitive member 5 is taken out of the image forming apparatus 1, and the toner weight on the photosensitive member 5 prior to the transfer step is detected in order to determine the developed toner amount per unit area $(M/A)_D$. Also, the toner weight on the photosensitive member 5 after the transfer step is detected in order to determine the residual toner amount per unit area $(M/A)_{NT}$. In an experiment, $(M/A)_D$ and $(M/A)_{NT}$ were detected by the suck-in method. Specifically, the toner attached to the photosensitive member was collected using a vacuum pump, and the weight M of the toner attached to a filter installed between the pump and a suction outlet was determined, and then M/A was calculated from the toner suction area A. The transfer rate was calculated from $(M/A)_D$ and $(M/A)_{NT}$ by the following equation (1), where the numerator corresponds to the transferred toner amount per unit area:

$$\text{Transfer rate}=100\times((M/A)_D-(M/A)_{NT})/(M/A)_D \quad (1)$$

The transfer rate may be determined by other methods. In an example, the transfer rate may be determined from the developed toner amount on the photosensitive member 5 and the transferred toner amount on the intermediate transfer belt 11. In another example, the transfer rate may be determined from the residual toner amount on the photosensitive member 5 and the transferred toner amount on the intermediate transfer belt 11.

As indicated by the solid line in FIG. 3, as the transfer electric field increases, the transfer rate increases and saturates. Above a certain electric field, the transfer rate decreases due to the influence of discharge. As the toner degrades, the transfer efficiency decreases, so that the dependency of the transfer rate on the transfer electric field varies as indicated by the broken line in FIG. 3. As will be seen from FIG. 3, while the transfer rate decreases due to toner degradation, the degree of the decrease in the transfer rate varies depending on the transfer electric field. While the decrease in transfer rate in the case of a reference electric field that maximizes the transfer rate is relatively small, the decrease in transfer rate in an electric field smaller or greater than the reference electric field is large.

This insight has led to the realization that the state of toner degradation can be detected with high sensitivity on the basis of the magnitude of the transfer rate decrease in an electric field lower or higher than the reference electric field. As the transfer electric field used for the detection of the state of toner degradation, it is necessary to select a transfer electric field that has as much transfer rate decrease as possible.

As mentioned above, the reference electric field refers to an electric field that maximizes the transfer rate. It is actually difficult to strictly determine the reference electric field. Thus, in practice, the term "reference electric field" may refer to a range of electric fields near the ideal reference electric field, as long as the range is such that the transfer rate does not decrease excessively.

As described above, the detection of transfer rate requires the detection of either the developed toner amount and the residual toner amount, the developed toner amount and the transferred toner amount, or the transferred toner amount and the residual toner amount. Thus, each of the image forming units 10 requires two detectors, resulting in an increase in cost. However, according to Equation (1), transfer rate can be determined by detecting either the residual toner amount $(M/A)_{NT}$ or the transferred toner amount $(=((M/A)_D-(M/A)_{NT})$ on the intermediate transfer belt 11 when the developed toner amount $(M/A)_D$ is constant. Thus, in this case, each image density detecting unit 29 requires only one detecting element, so that the cost can be reduced.

Under the same state of developing agent and the same developing conditions, the developed toner amount on the photosensitive member 5 is constant. If the state of the developing agent changes due to environmental conditions or degradation, for example, the developed toner amount changes even when the developing conditions are the same. If the developed toner amount changes, the residual toner amount or the transferred toner amount changes even when the transfer rate is the same. Thus, it cannot be distinguished whether a change in the residual toner amount or the transferred toner amount is due to a change in the developed toner amount or the transfer rate.

While the developed toner amount can be detected by detecting the toner amount on the photosensitive member before transfer, such detection of image density of the untransferred toner results in a waste of toner and an increase in the amount of toner that is disposed of. Thus, it is necessary to make it possible to evaluate a decrease in transfer rate due to the degradation of toner even when the developed toner amount varies. Even when the developed toner amount changes, the relationship between the residual toner amount or the transferred toner amount and the transfer electric field does not change as long as there is no change in the transfer rate, although the absolute values of the residual toner amount or the transferred toner amount may change.

Thus, it has been found that the decrease in transfer rate due to toner degradation can be evaluated even when the developed toner amount varies, by detecting the toner amount in terms of an image density using the image density detecting unit 29, and evaluating the difference or ratio of the residual toner amount in the case of the reference electric field or in the vicinity thereof, to the residual toner amount in the case of a certain transfer electric field that may be smaller or greater than the reference electric field. The reference electric field may be a transfer electric field that maximizes the transfer rate, where the variation of the transfer rate due to degradation is relatively small.

The transfer electric field may be controlled either by a constant current control method or a constant voltage control method, each having its own advantages. The constant current control method can maintain a constant transfer electric field even when the resistance of the transfer material changes due to environmental variations or the like. The constant voltage control method is associated with little variations in the transfer electric field due to differences in the image area. For the purpose of controlling the electric field in accordance with the present embodiment, the constant current control method is used.

Figure 4:
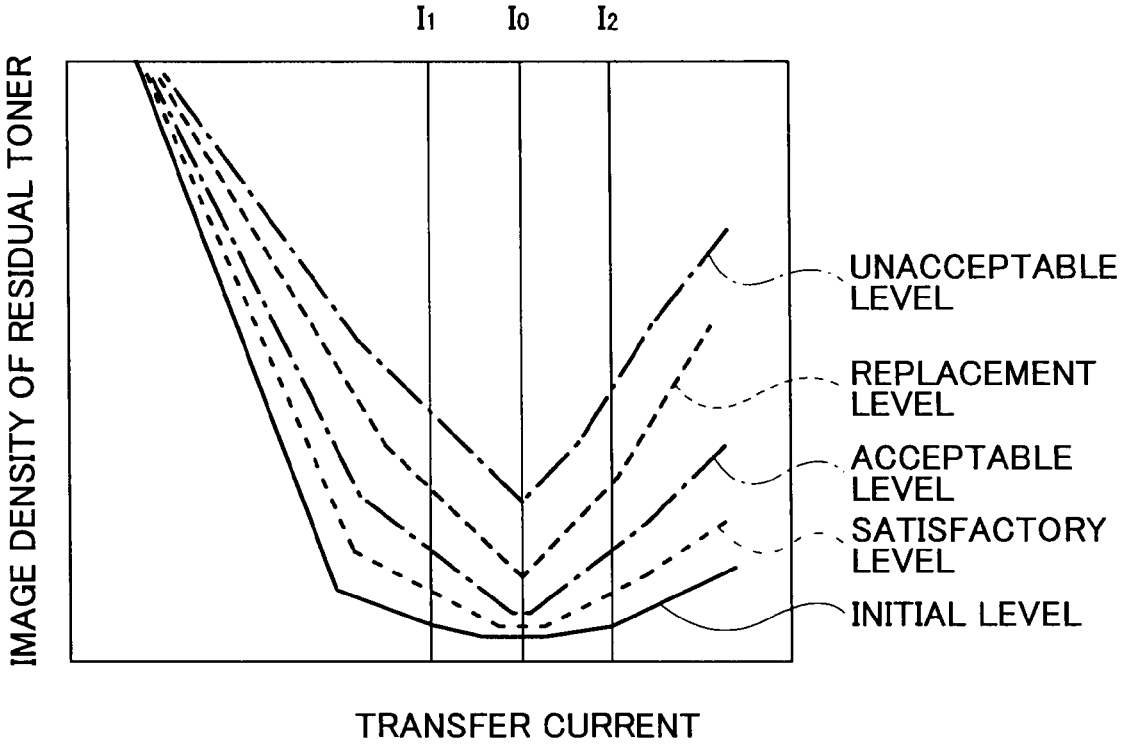
FIG. 4 shows a graph indicating relationships between transfer current and the image density of residual toner at various levels of toner degradation.

FIG. 4 shows a graph indicating relationships between transfer current and the image density of residual toner at various levels of toner degradation. With reference to FIG. 4, a toner degradation state detection method is described. First, the transfer step performed in the image forming apparatus 1 is considered.

First, using an initial-stage developing agent that has not been degraded, the image density of residual toner obtained with various transfer currents is detected by the image density sensor 29. Then, the relationship between the image density of residual toner and the transfer current is determined. Also, various images obtained with the initial-stage developing agent are evaluated.

Similarly, for developing agents with varying degradation states, the relationship between the image density of residual toner and the transfer current are determined, and various images are evaluated. The above evaluation needs to be performed for each color of toner because the characteristics of the toner may vary depending on its color.

Based on the relationship between the image density of residual toner and transfer current and based on the evaluation of images, various states of the toner being used can be determined, such as the initial-stage level, a satisfactory level, an acceptable level, a replacement level, and an unacceptable level, as shown in FIG. 4.

Thus, the image forming method according to the present embodiment includes the first detecting step of detecting the image density of an image transferred with a predetermined reference current, the second detecting step of detecting the image density of an image transferred with a current smaller or greater than the reference current, and the processing step of determining the state of degradation of toner based on the image density detected in each detecting step, and of processing the degraded toner.

As shown in FIG. 4, based on the relationship between the image density of residual toner and the transfer current in each of the toner degradation states, a transfer current $I_0$ with which the image density of the residual toner used for the detection of the toner degradation state becomes minimum, and one or more transfer currents $I_1$ smaller than $I_0$ are selected. At each of the levels shown in FIG. 4, the image density of residual toner at $I_0$ and the image density of residual toner at $I_1$ are determined, and the toner degradation state is determined. Then, an upper limit of image density below which a processing step, such as the discharge of degraded toner, is not performed is set. Instead of $I_1$, the current $I_2$ that is greater than the reference current $I_0$ may be used for the determination of the image density of residual toner.

If it is determined that the toner is degraded at a level that is practically problematic, the degraded toner is processed, which may involve a process to discharge the degraded toner or replace the developing agent including the degraded toner. An alert prompting such a process, or an alert to supply new toner may also be displayed.

In the process of discharging the degraded toner, the degraded toner may be forcibly developed on the photosensitive member 5 and then collected by the cleaning device 8. This sequence may be performed for each of the image forming units 10, either at different times or simultaneously. When the sequence is performed simultaneously, the detection of toner state needs to be completed before the toner transferred in one image forming unit 10 is transported to the transfer roller 9 of another image forming unit 10.

Thus, the degradation state of toner can be known by detecting the image density $A_0$ of the residual toner when a toner image is transferred with the reference transfer current that maximizes the transfer rate, and the image density $A_1$ of the residual toner when the image is transferred with a transfer current that is smaller or greater than the transfer-rate-maximizing transfer current. Also, the degradation of toner can be detected with high sensitivity based on the ratio or difference between the image densities detected in the first detecting step and the second detecting step.

Figure 5:
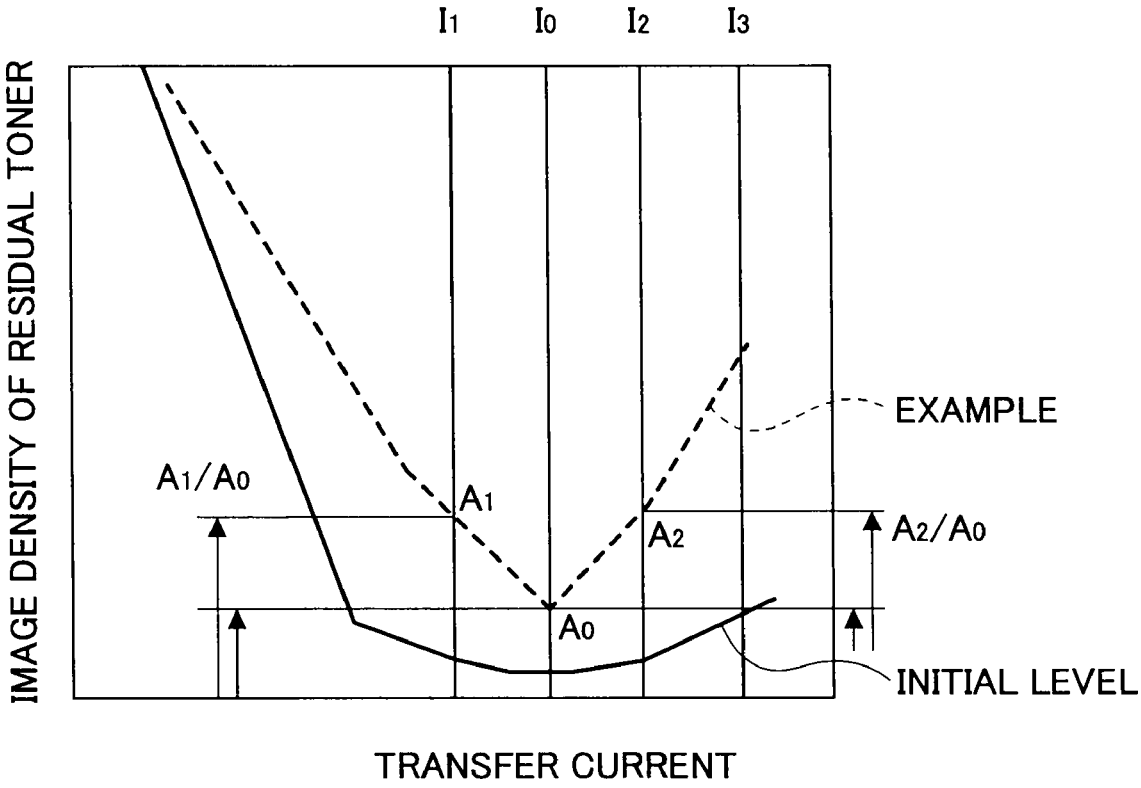
FIG. 5 shows a graph indicating relationships between transfer current and an image density ratio of residual toner.

Hereafter, a sequence of detecting the toner degradation state is described with reference to FIG. 5 showing a graph indicating a relationship between the transfer current and the image density ratio of residual toner.

In this sequence, the photosensitive member 5 is developed such that a predetermined amount of toner attaches to the photosensitive member 5, and then the image is transferred to a recording medium with the reference current $I_0$. The image density $A_0$ of the residual toner on the photosensitive member 5 is detected by the density detecting unit 29. Similarly, a transfer step is performed with the transfer current $I_1$, and the image density $A_1$ of the residual toner is detected. Then, the image density ratio $A_1/A_0$ is calculated.

When the image density ratio $A_1/A_0$ is greater than an upper limit set value, the degraded toner is discharged. Specifically, in order to discharge the degraded toner, the degraded toner is forcibly developed on the photosensitive member 5, and then collected by the cleaning device 8.

The above sequence is performed for each of the image forming units 10Y, 10M, 10C, and 10K, either at different times or simultaneously. When performed simultaneously, the detection of toner degradation needs to be completed before the toner transferred in one image forming unit is transported to the transfer unit of another.

In another embodiment, the image density of the residual toner may be detected with two or more transfer currents smaller than the reference current, two or more transfer currents greater than the transfer current, or one or more transfer currents smaller than the transfer current and one or more transfer currents greater than the reference transfer current. Then, the ratio of each image density $A_1, A_2, \ldots$ to $A_0$, i.e., $A_1/A_0, A_2/A_0, \ldots$ may be determined so that the toner degradation state can be evaluated based on these plural ratios. In this way, a more accurate detection can be made.

Figure 6:
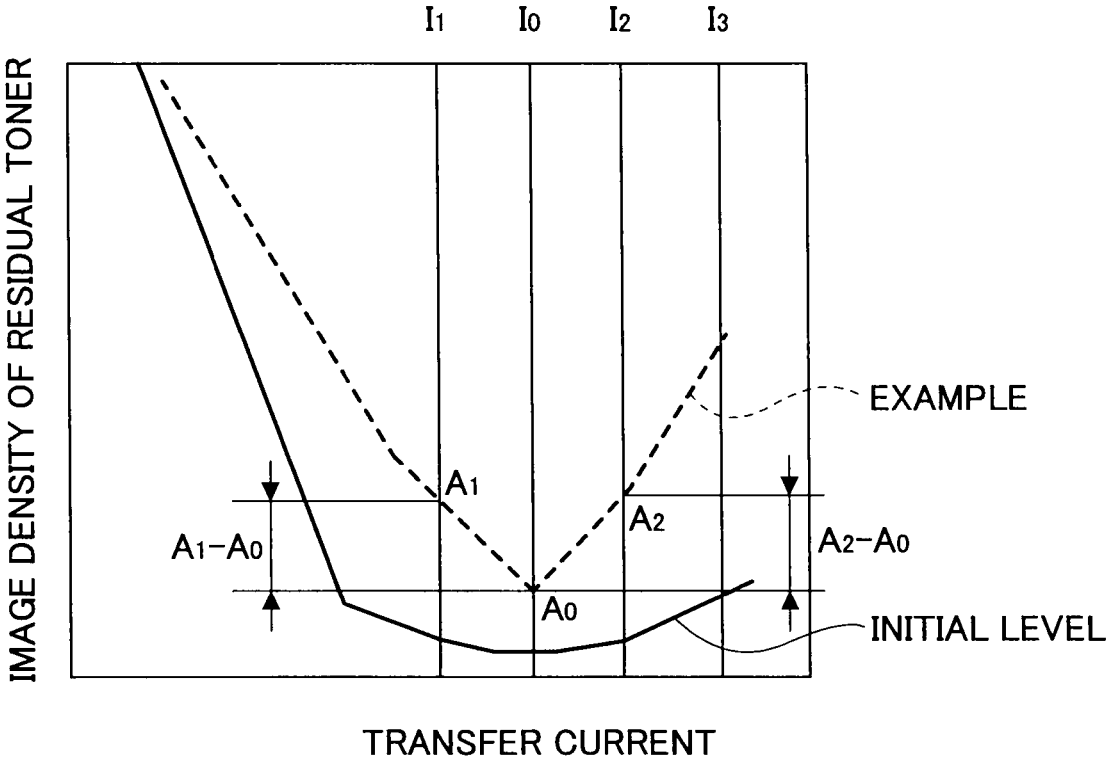
FIG. 6 shows a graph indicating relationships between transfer current and an image density difference of residual toner.

FIG. 6 shows a graph indicating the relationships between the transfer current and the image density difference of residual toner.

The image density of an image transferred with a single transfer current smaller or greater than the reference current is detected. Alternatively, the image density of residual toner may be detected with two or more transfer currents smaller than the reference current, two or more transfer currents greater than the transfer current, and one or more transfer currents smaller than the transfer current and one or more transfer currents greater than the reference transfer current. Then, the difference between each image density $A_1, A_2, \ldots$ and $A_0$, i.e., $A_1-A_0, A_2-A_0, \ldots$ may be determined in order to evaluate the toner degradation state based on these plural difference values, so that a more accurate detection can be made.

The image forming method according to the present embodiment can be applied to the color image forming apparatus shown in FIG. 1, which includes plural image forming units 10. For developing agents with varying degradation states, the relationship between the image density of residual toner and the transfer current is determined, and various images are evaluated. In this case, the aforementioned image forming method is performed for each of the image forming units 10 or for each color of toner because the characteristics of the toner may vary from one color to another.

In the foregoing description, the image density of toner image detected in the detecting step has been based on the residual toner image on the photosensitive member 5. However, it has been found that, as mentioned above, the progress of degradation of toner can be detected with high sensitivity on the basis of the ratio or difference between the image densities detected on the intermediate transfer belt 11 in the first detecting step and the second detecting step.

When detecting the image density on the intermediate transfer belt 11 by the image density detecting unit 29, a single image density detecting unit 29 may be disposed downstream of the most downstream unit 10, where the image transferred in one image forming unit 10 is prevented from being transferred in another unit downstream. In this way, the image density in each image forming unit 10 can be detected, whereby the cost of the image forming apparatus 1 can be reduced and its structure can be simplified.

When detecting the image density on the intermediate transfer belt 11, the variation between the image density detecting unit 29 and the intermediate transfer belt 11 can be prevented by installing the image density detecting unit 29 above or near a roller supported by the intermediate transfer belt 11, such as the drive roller 14.

Figure 7:
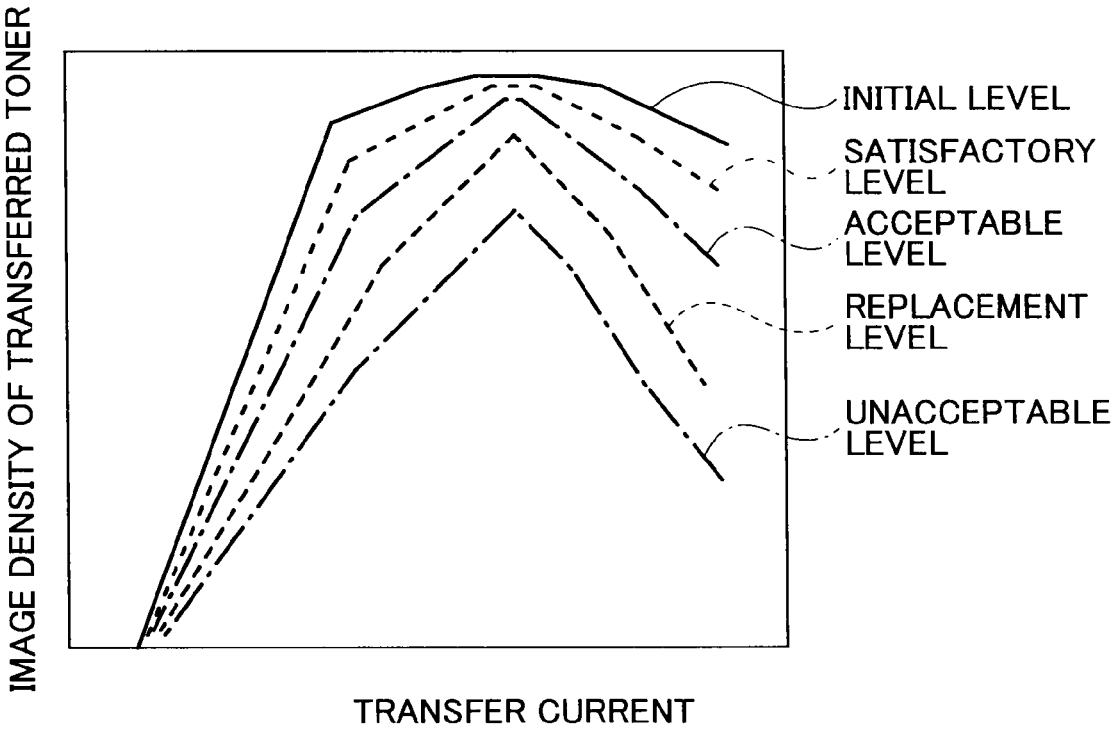
FIG. 7 shows a graph indicating relationships between transfer current and the image density of the transferred toner at various levels of toner degradation.

FIG. 7 shows a graph indicating the relationship between the transfer current and the image density of transferred toner at various levels of toner degradation. It can be seen that the levels vary from the initial-stage level with no degradation, to a satisfactory level, an acceptable level with no apparent image defect, a replacement-requiring level where, although there is no problem identifying character or other information, an image defect is starting to appear, to an unacceptable level where character or other information cannot be identified.

Figure 8:
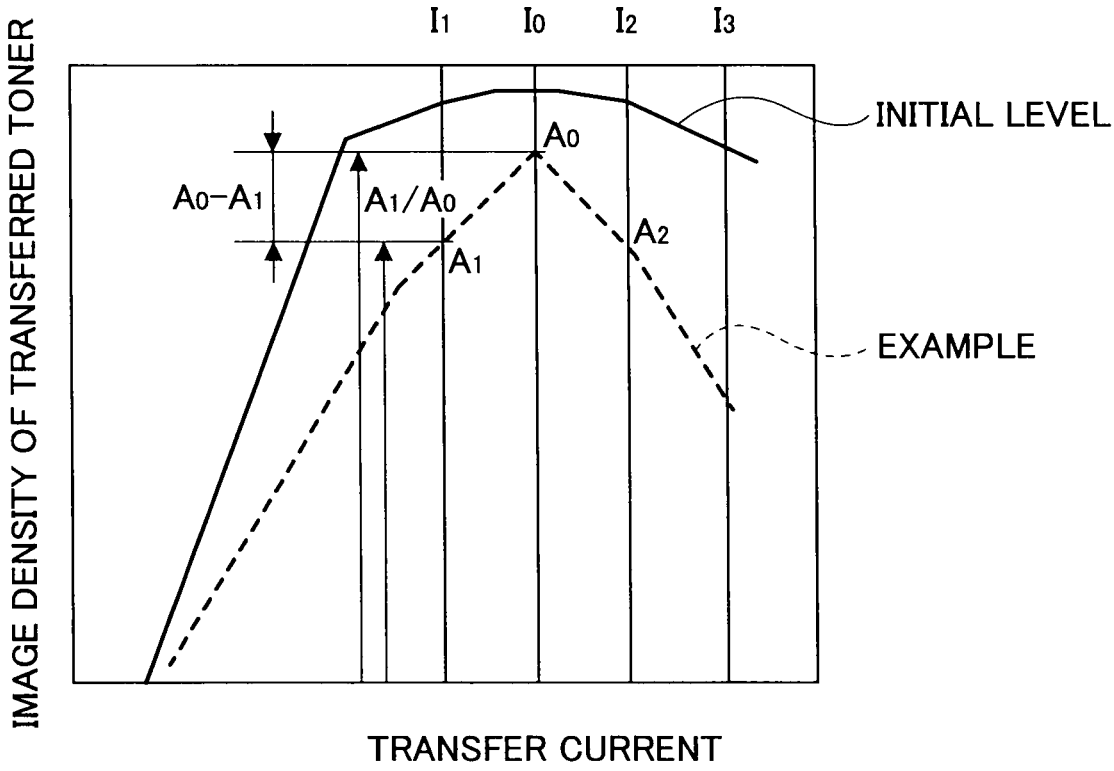
FIG. 8 shows a graph indicating relationships between transfer current and an image density difference/ratio of transferred toner.

FIG. 8 shows a graph indicating the relationship between the transfer current and the image density difference or ratio of the transferred toner images. By evaluating the difference or ratio of one image density to another detected by the first detecting step and the second detecting step in the detection example, the toner degradation state can be determined.

In the image forming method according to the present embodiment, the first detecting step includes detecting the image density of an image transferred from the photosensitive member 5 to the intermediate transfer belt 11 with the reference current. The second detecting step includes detecting the image density of the image transferred from the photosensitive member 5 to the intermediate transfer belt 11 with a current smaller or greater than the reference current. Based on the image densities of these transferred toner images, the toner degradation state is determined in a processing step. The determination in the processing step is based on the ratio or difference between the image densities of the transferred toner images. This is the same method as the aforementioned method whereby the image density difference or ratio of residual toner is detected and then processed in the processing step.

More specifically, in the first detecting step, the image density $A_0$ of the transferred toner image that has been transferred with the image-density-maximizing reference current is detected.

Then, in the second detecting step, the image density $A_1$ of the transferred toner image that has been transferred with a transfer current that is smaller or larger than the reference current is detected. In the illustrated example shown in FIG. 8, the lower transfer current is used. The smaller the image density ratio $A_1/A_0$ of the transferred toner image, the greater is the degree of toner degradation. Such detection can be made with high sensitivity. Thus, the toner degradation level can be determined on the basis of the magnitude of the image density ratio $A_1/A_0$.

Similarly, it has been found that the greater the image density difference $A_0-A_1$ of the transferred toner image, the greater is the degree of toner degradation, and such detection can be made with high sensitivity. Thus, the toner degradation level can be determined on the basis of the magnitude of the image density difference $A_0-A_1$ of the toner image transferred with the predetermined transfer currents.

When the unacceptable level is reached in the processing step, the degraded toner is processed. As long as the unacceptable level is not reached, the image forming operation is continued.

Figure 9:
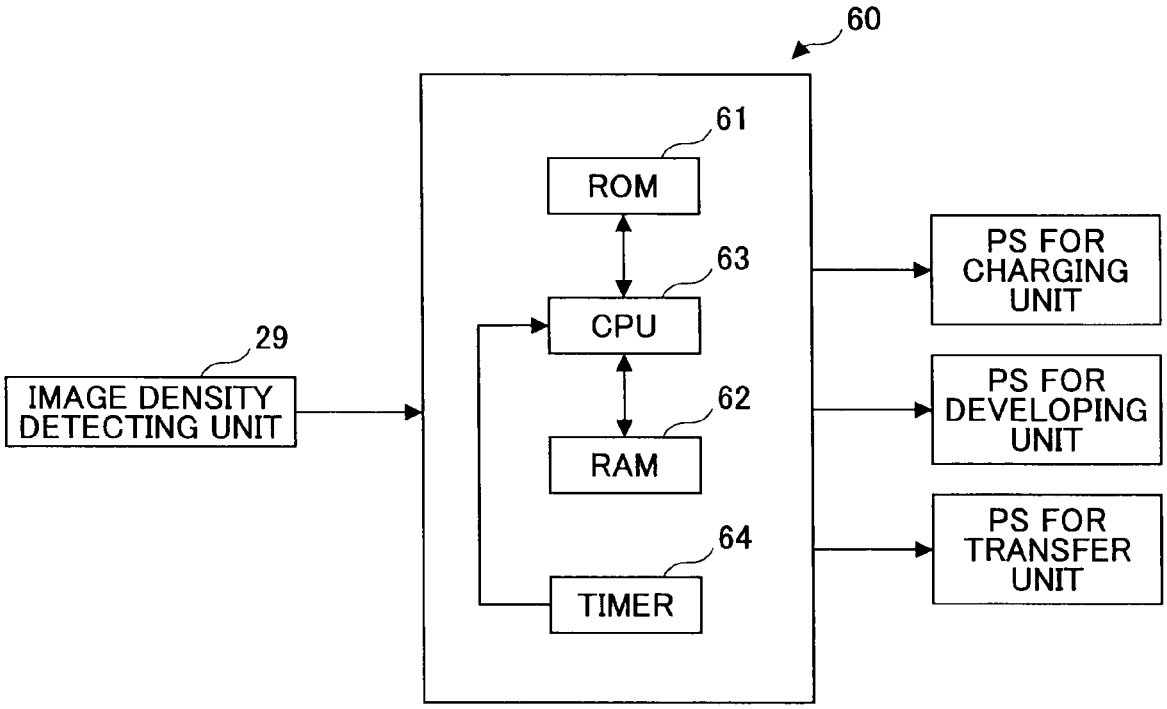
FIG. 9 shows a block diagram of a control unit used for an image forming method according to an embodiment of the present invention.

Hereafter, a description is given of a control unit used with the image forming method according to the present embodiment. The image forming apparatus 1 includes a control unit 60 whose block diagram is shown in FIG. 9. The control unit 60 comprises a computer as known in the art, including memory units such as a read-only memory (ROM) 61 and a random access memory (RAM) 62; a central processing unit (CPU) 63; and a timer 64. An input end of the control unit 60 is connected to an image density sensor via a signal line. An output end of the control unit 60 is connected with power supplies (PS) to a charging unit, a developing unit, and a transfer unit via signal lines. The control unit 60 may store set values of the transfer currents $I_0$ and $I_1$, or upper limit set values of image density ratios.

(First Embodiment)

Figure 10:
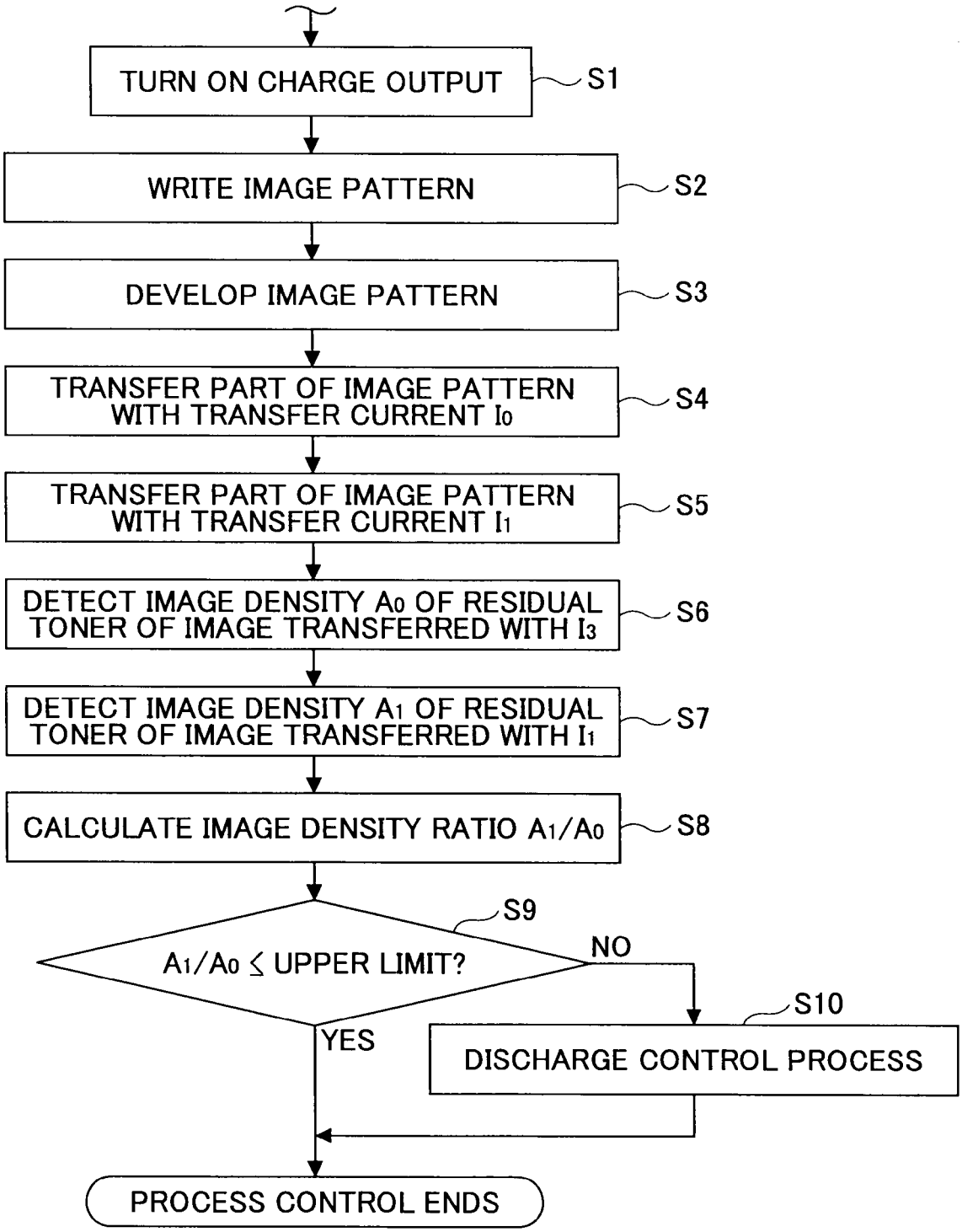
FIG. 10 shows a flowchart of a control sequence of an image forming method according to an embodiment.

In the image forming apparatus 100, a process control for controlling the image density or adjusting each color is performed upon turning on of power supply or after producing a predetermined number of output sheets, or upon detection of an environmental change. Following such existing control sequences, a control process shown in FIG. 10 is performed. FIG. 10 shows a flowchart of a control process according to the image forming method of the present embodiment.

In step S1, following the end of the process sequence, the power supply to the charging device 6 is controlled to turn on a charge output.

In step S2, an image pattern is written on each of the photosensitive members 5 using an amount of light corresponding to a set image density, thereby forming a latent image.

In step S3, the image patterns are developed with a toner using the developing device 7, forming toner images.

In step S4, the images of some of the image patterns are transferred with the reference current $I_0$ of the transfer device 9.

In step S5, the images of the remaining image patterns are transferred with the transfer current $I_1$.

In step S6, which is the first detecting step, the image density $A_0$ of the residual toner of the images transferred with the reference current $I_0$ is detected by the image density detecting unit 29.

In step S7, which is the second detecting step, the image density $A_1$ of the residual toner of the images transferred with the transfer current $I_1$ is detected by the image density detecting unit 29.

In step S8, which is the processing step, the image density ratio $A_1/A_0$ is calculated by the control unit 60 based on the detected plural image densities.

In step S9, the control unit 60 determines whether the image density ratio $A_1/A_0$ is equal to or greater than the upper limit set value that is set for the individual image forming apparatus in advance. When the predetermined condition is satisfied, the control process ends; if not, the discharge of the degraded toner is performed in step S10.

Thereafter, the process control sequence ends.

In this way, it can be determined whether the toner is degraded. When it is determined that the toner is degraded and that a defective image can be expected, the degraded toner alone can be removed from the developing agent as a whole, so that the development of a defective image can be prevented.

(Second Embodiment)

While in the foregoing embodiment, the transfer current $I_1$ that is smaller than the reference current $I_0$ has been used as the transfer current for determining the image density ratio, a transfer current greater than the reference current $I_0$ may be used. Further, while in the foregoing embodiment, one transfer current for determining the image density ratio has been set, two or more transfer currents smaller than the reference current $I_0$ may be set. Alternatively, two or more transfer currents greater than the reference current $I_0$ may be set. Further alternatively, two or more combinations of a transfer current smaller than the reference current $I_0$ and a transfer current greater than the reference current $I_0$ may be set.

The embodiment in which two or more transfer currents greater than the reference current $I_0$ are set is described below.

From the relationship between the image density of residual toner and the transfer current at each of the toner degradation states, the reference current $I_0$ that minimizes the image density of the residual toner used for the detection of the toner degradation state, and transfer currents $I_2$ and $I_3$ greater than the reference current $I_0$ are selected. Then, the image density on the transfer belt in the case of the reference current $I_0$, and the image density of the residual toner in the case of $I_2$ and $I_3$ are detected. Thereafter, the ratio of the image density of the residual toner at the reference current $I_0$ to an average value of the image densities of the residual toner at $I_2$ and $I_3$ is determined, and an upper limit value of the image density ratio below which the discharge of the degraded toner is not performed is set.

Figure 11:
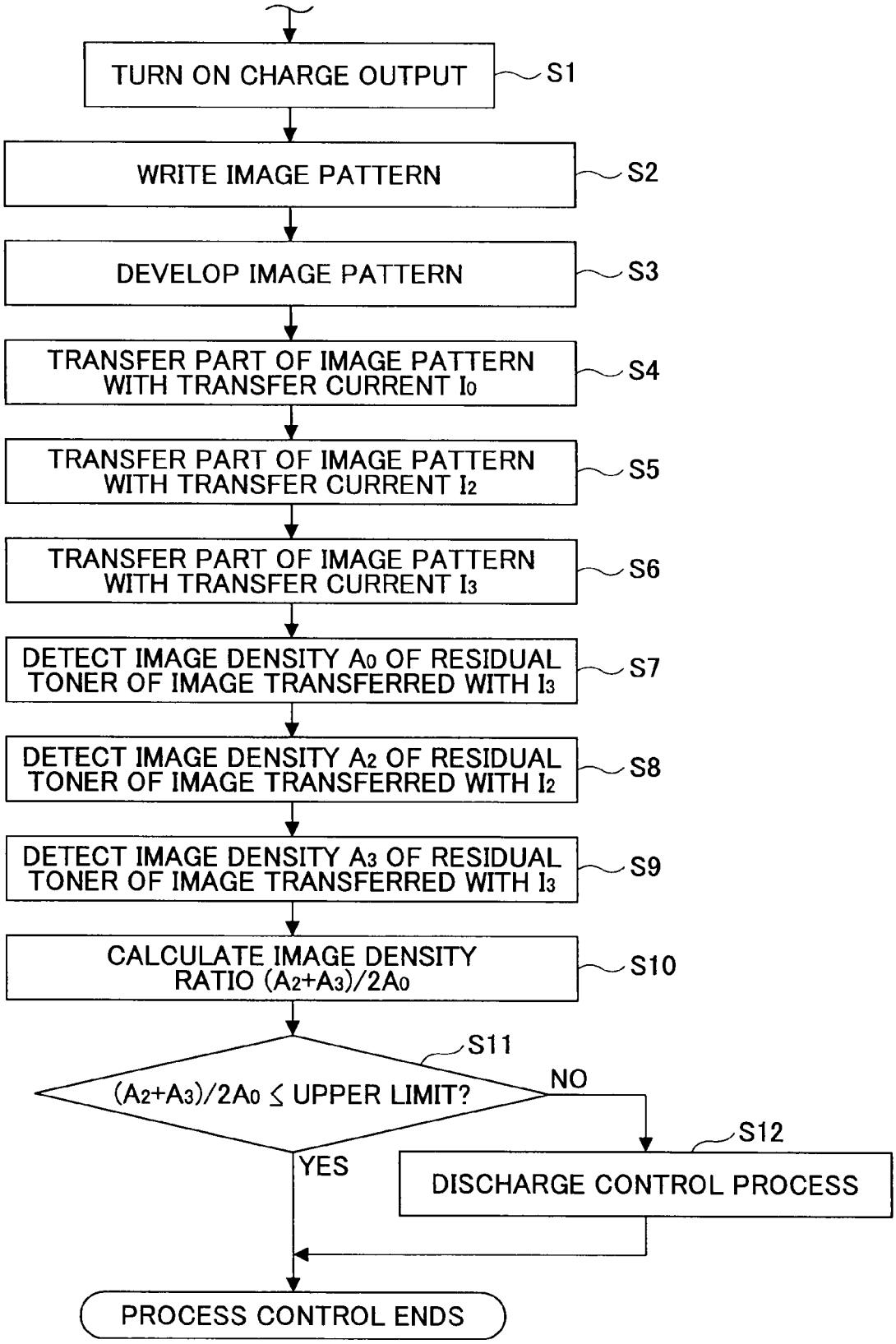
FIG. 11 shows a flowchart of a control sequence of an image forming method according to another embodiment.

FIG. 11 shows a flowchart of a control process by the image forming method according to the present embodiment. Steps S1 to S3 are the same as the corresponding steps shown in FIG. 7. In step S4, some of the image patterns are transferred with the reference current $I_0$. Some other of the image patterns are transferred with the transfer current $I_2$ in step S5. In step S6, the remaining toner images are transferred with the transfer current $I_3$. In step S7, the image density of the residual toner $A_0$ in the case of the reference current $I_0$ is detected. In step S8, the image density of $A_2$ of the residual toner in the case of the transfer current $I_2$ is detected. In step S9, the image density $A_3$ of the residual toner in the case of the transfer current $I_3$ is detected. In step S10, $(A_2+A_3)/2A_0$ is calculated. In step S11, it is determined whether $(A_2+A_3)/2A_0$ is equal to or greater than the upper limit set value. If this condition is satisfied, the control process ends; if not, the process of discharging the degraded toner is started in step S12.

Then, the process control sequence ends.

(Third Embodiment)

In the foregoing embodiments, the image density of the residual toner on the photosensitive member 5 has been detected so that the processing step can be performed. In the present embodiment, the image density of the transferred toner on the intermediate transfer belt 11 is detected so that the processing step can be performed.

Figure 12:
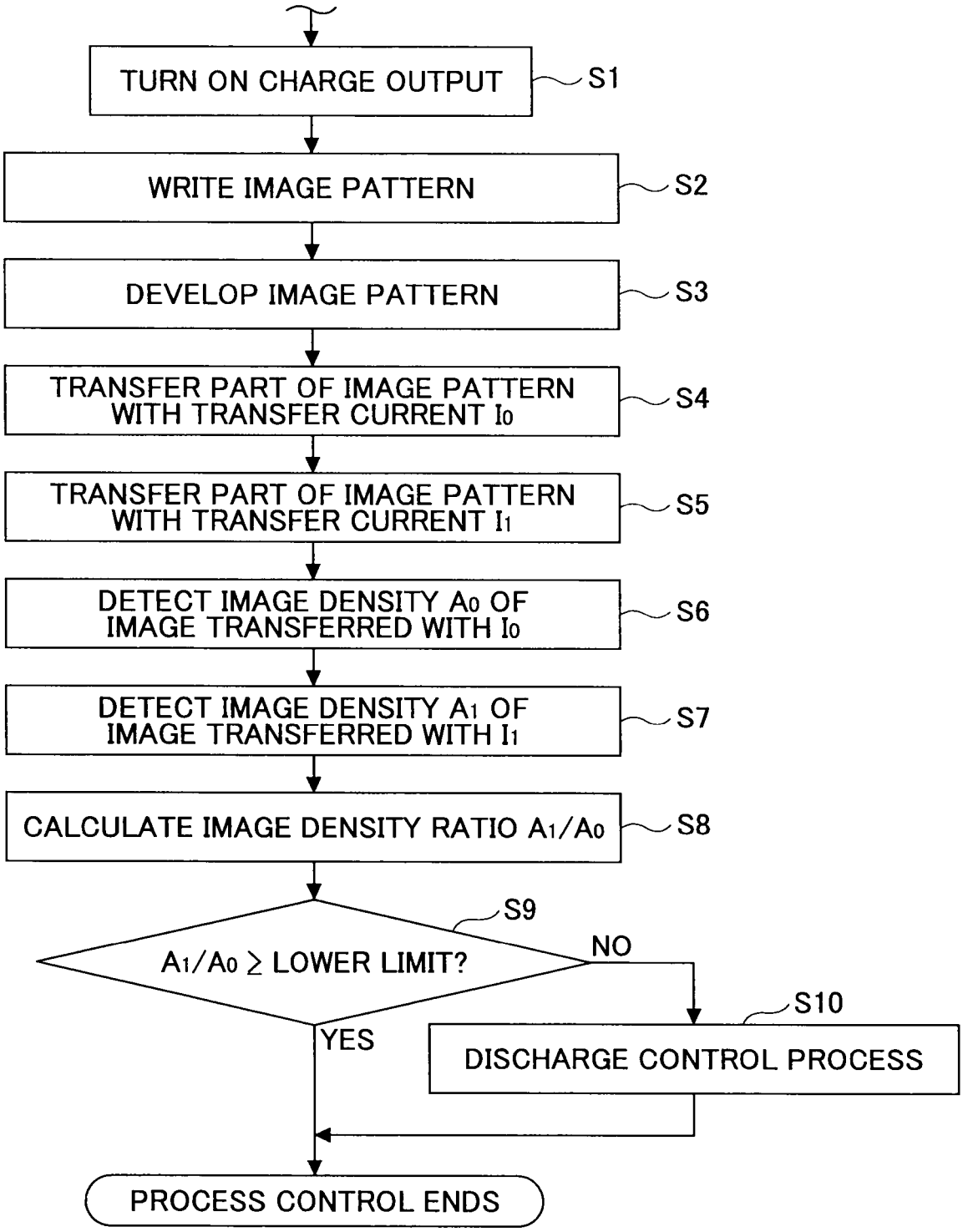
FIG. 12 shows a flowchart of a control sequence of an image forming method according to yet another embodiment.

FIG. 12 shows a flowchart of a control sequence of the image forming method according to the present embodiment.

Initially, following the end of the process control sequence, the power supply to the charging device 6 is controlled in order to turn on the charge output (step S1).

In step S2, an image pattern is written on each of the photosensitive members 5 with an amount of light corresponding to the set image density, thereby forming a latent image.

In step S3, the image patterns are developed with toner using the developing device 7, thereby forming toner images.

In step S4, the images of some of the image patterns are transferred with the reference current $I_0$ of the transfer device 9.

In step 5, the images of the remaining image patterns are transferred with the transfer current $I_1$.

In step S6, which is the first detecting step, the image density $A_0$ of the transferred toner of the images that have been transferred with the reference current $I_0$ and formed on the intermediate transfer belt is detected by the image density detecting unit 29.

In step S7, which is the second detecting step, the image density $A_1$ of the transferred toner of the images that have been transferred with the transfer current $I_1$ and formed on the intermediate transfer belt is detected by the image density detecting unit 29.

In step S8, the ratio $A_1/A_0$ is calculated by the control unit 60 from the plural image densities detected in the processing step.

In step S9, it is determined by the control unit 60 whether the image density ratio $A_1/A_0$ is equal to or smaller than the lower limit set value that is set for the individual image forming apparatus in advance. If the predetermined condition is satisfied, the control sequence ends; if not, the discharge of the degraded toner is performed in step S10.

Thereafter, the process control sequence ends.

Thus, it can be determined whether the toner is degraded by detecting the transfer rate. Further, when the toner is in a degraded state and it can be expected that an image defect such as scumming will occur, the degraded toner alone can be removed out of the developing agent as a whole, so that the development of a defective image can be prevented.

While it has been described that the foregoing control flow is performed after the existing process control sequence, the timing of the control flow may be varied depending on the status of output or the like. The control flow may be performed either simultaneously or at different times for the individual colors of the toner, depending on the status of use of each color of toner or the like.

The present application is based on the Japanese Priority Applications No. 2007-313550 filed Dec. 4, 2007; No. 2008-055747 filed Mar. 6, 2008; No. 2008-095598 filed Apr. 2, 2008; and No. 2008-260353 filed Oct. 7, 2008, the entire contents of which are hereby incorporated by reference.

What is claimed is:

1. An image forming method comprising:

forming an electrostatic latent image on an electrostatic latent image carrier;

forming a toner image of the electrostatic latent image on the electrostatic latent image carrier;

transferring the toner image to an intermediate transfer member by forming an electric field between the electrostatic latent image carrier and the intermediate transfer member;

first detecting an image density of an image that is transferred using a predetermined reference electric field;

second detecting an image density of the image that is transferred using an electric field that is smaller or greater than the reference electric field;

determining a level of degradation of a degraded toner based on the image density detected by each of the first detecting and the second detecting; and determining to perform a processing of the degraded toner based on a comparison of a predetermined threshold with a value determined from the image density detected by the first detecting and the image density detected by the second detecting.

2. The image forming method according to claim 1, wherein each of the first and the second detecting includes detecting the image density of an image on the electrostatic latent image carrier.

3. The image forming method according to claim 1, wherein the predetermined reference electric field is an electric field that maximizes the transfer rate.

4. The image forming method according to claim 1, further comprising:

processing the degraded toner based on the level of degradation of the degraded toner determined in the determining, the processing includes moving the degraded toner in the developing device onto the electrostatic latent image carrier.

5. The image forming method according to claim 1, further comprising:

determining to perform a processing of the degraded toner or not based on a comparison of a ratio of the image density detected by the first detecting to the image density detected by the second detecting with a predetermined threshold value.

6. The image forming method according to claim 1, further comprising:

determining to perform a processing of the degraded toner or not based on a comparison of a difference between the image density detected by the first detecting and the image density detected by the second detecting with a predetermined threshold value.

7. The image forming method according to claim 1, wherein each of the first and the second detecting includes detecting the image density of an image on the intermediate transfer member.

8. The image forming method according to claim 7, wherein the predetermined reference electric field is an electric field that maximizes the transfer rate.

9. The image forming method according to claim 7, further comprising:

processing a degraded toner based on the level of degradation of the degraded toner determined by the determining, wherein the processing includes moving the degraded toner in a developing device onto the electrostatic latent image carrier.

10. The image forming method according to claim 7, further comprising:

determining to perform a processing of the degraded toner or not based on a comparison of a ratio of the image density detected by the first detecting to the image density detected by the second detecting with a predetermined threshold value.

11. The image forming method according to claim 7, further comprising:

determining to perform a processing of the degraded toner or not based on a comparison of a difference between the image density detected by the first detecting step and the image density detected by the second detecting step with a predetermined threshold value.

12. The image forming method according to claim 1, wherein the second detecting includes detecting the image density of an image that is transferred using plural electric fields.

13. The image forming method according to claim 1, wherein the electric field between the electrostatic latent image carrier and the intermediate transfer member is controlled with a current.

14. The image forming method according to claim 1, wherein the electric field between the electrostatic latent image carrier and the intermediate transfer member is controlled with a voltage.

15. The image forming method according to claim 1, wherein the forming the electrostatic latent image, the forming the toner image, and the transferring the toner image are performed for each of plural colors, wherein each of the first detecting and the second detecting includes detecting an image density of each color of the image.

16. An image forming apparatus comprising:

an electrostatic latent image carrier on which a latent image is formed;

a charging device configured to charge a surface of the electrostatic latent image carrier uniformly;

an exposing device configured to expose the charged surface of the electrostatic latent image carrier to light in order to write a latent image on the surface;

a developing device configured to supply a toner to the latent image formed on the surface of the electrostatic latent image carrier in order to render the latent image visible;

a cleaning device configured to clean the surface of the electrostatic latent image carrier to remove residual toner;

a transfer device configured to transfer the visible image on the surface of the electrostatic latent image carrier to a recording medium directly or via an intermediate transfer member; and a fusing device configured to fuse the toner image on the recording medium, wherein an image density of an image that is transferred using a predetermined reference electric field is detected, and an image density of the image that is transferred using an electric field that is smaller or greater than the reference electric field is detected, a level of degradation of degraded toner is determined based on the image density of the image transferred using the reference electric field and the image density of the image transferred using the electric field that is smaller or greater than the reference electric field; and a determination to perform a processing of the degraded toner is performed based on a comparison of a predetermined threshold with a value determined from the image density detected by the first detecting and the image density detected by the second detecting.

* * * * *